US005695114A

United States Patent [19]

Evans

[11] Patent Number: 5,695,114

[45] Date of Patent: Dec. 9, 1997

[54] COLLECTION AND RECYCLING APPARATUS

[76] Inventor: Janice Evans, 1044 Bond St., Elizabeth, N.J. 07201

[21] Appl. No.: 496,424

[22] Filed: Jun. 29, 1995

[51] Int. Cl.[6] ..... B65D 91/00

[52] U.S. Cl. ..... 232/43.2; 220/909

[58] Field of Search ..... 232/43.1, 43.2, 232/93.5, 44; 220/909, 476

[56] References Cited

U.S. PATENT DOCUMENTS

| | | | |
|---|---|---|---|
| 3,754,501 | 8/1973 | Horn | 232/43.1 X |
| 4,013,215 | 3/1977 | Mercier | 232/43.1 |
| 4,380,316 | 4/1983 | Glinka et al. | 232/43.2 X |
| 5,035,563 | 7/1991 | Mezey | 220/909 X |
| 5,078,567 | 1/1992 | Lombardo | 220/909 X |
| 5,098,250 | 3/1992 | Carson | 220/909 X |
| 5,103,998 | 4/1992 | Caro et al. | 202/909 X |
| 5,174,468 | 12/1992 | Holderman | 220/909 X |
| 5,213,402 | 5/1993 | Bernal et al. | 232/43.1 X |
| 5,257,577 | 11/1993 | Clark | 232/43.2 X |
| 5,458,287 | 10/1995 | Jones et al. | 232/43.1 |

*Primary Examiner*—Kenneth J. Dorner
*Assistant Examiner*—Jerry Redman

[57] ABSTRACT

A refuse collection and recycling apparatus for primary household use for the purpose of collecting, separating and recycling refuse such as paper, plastics, cans, bottles and food, generated in the home, stores, and offices by means of a sample operation using a device of simple construction. The refuse collection and recycling apparatus will generally comprise a chute for discarding refuse. The front end and bottom end of the chute has an opening and inner and outer surfaces. The apparatus also contains a hollow housing having an opening in its top end and a back door. The hollow housing is attached to the bottom end of the chute in such a way that the openings in the bottom end of the chute and top end of the hollow housing are aligned directly over one another. The apparatus further contains a removable hollow caddy which is positioned inside the hollow area of the housing when the back door is open. The apparatus still further contains one or more refuse containers positioned inside the hollow area of the caddy for collecting and recycling garbage.

11 Claims, 3 Drawing Sheets

COLLECTION AND RECYCLING APPARATUS

BACKGROUND OF THE INVENTION

This invention relates to a refuse collection apparatus for primary household use for the purpose of collecting, separating and recycling refuse such as paper, plastics, cans, bottles, food and the like, generated in the home, stores, and offices by means of a simple operation using a device of simple construction.

Today more and more federal, state and local government laws are being implemented and enforced to address the need for environmental conservation. In particular, most cities across the county have adopted some form of recycling ordinance which targets items such as bottles, paper, cans and plastics all which can be recycled in an effort to preserve the environment. The city ordinance generally requires that bottles, paper, cans, plastics and the like be separated from the common household garbage, such as food and non-recyclable paper waste, prior to being delivered to the garbage pick-up site. This is accomplished, primarily, by having two or more garbage containers located most likely in the kitchen of the house. The recyclable are collected in one container and the common household garbage is collected in another. The garbage containers, which can be heavy at times, are then hauled to the curb. These wastes are then typically processed centrally, by sending garbage collection tracks around on a predetermined schedule to collect the trash and recyclable, and then hauling them to a central processing facility for incineration/burial or recycling.

However, many people find recycling to be time consuming, inconvenient and bothersome. For example, to comply with a recycling ordinance a household would have to contain two or more garbage containers in the kitchen area, which would necessarily take away kitchen space and would most likely negatively affect the kitchen decor. If the garbage containers are kept in the garage, for instance, this would require a trip to the garage every time a piece of garbage had to be discarded.

As a result, there is a need for an apparatus which will increase the compliance and effectiveness of a towns recycling program.

SUMMARY OF THE INVENTION

The object of the present invention is to therefore provide a collection and recycling apparatus which will increase the initiative for effective recycling by reducing the need to maneuver heavy garbage containers to the curb, reducing the number of containers located in the house by providing a multi-compartment collection apparatus wherein the garbage containers are located on the outside of the dwelling and reducing the number of trips made to the garbage pick up site.

In order to achieve the aforementioned objective, a collection and recycling apparatus for recycling refuse will generally comprise a chute having two side walls with outer surfaces, a top end, bottom end and front end, for discarding refuse. The front end and bottom end of the chute has an opening and inner and outer surfaces. The apparatus also contains a hollow housing having a top end with an opening and a back door. The hollow housing is attached to the bottom end of the chute in such a way that the openings in the bottom end of the chute and top end of the hollow housing are aligned directly over one another. The apparatus, further contains a removable hollow caddy which is positioned inside the hollow area of the housing when the back door is open. The apparatus still further contains one or more refuse containers positioned inside the hollow area of the caddy in such a way that a refuse container is aligned with each compartment made by the partitions. The chute can be compartmentalized by the addition of one or more dislodgeable partitions and the hollow caddy can also optionally be used as a refuse container.

The collection and recycling apparatus is attached to a house/dwelling by inserting the chute through a window or customized cavity. The collection and recycling apparatus will preferably contain multiple compartments for separating bottles, cans, plastics, common garbage, paper and the like, or a combination thereof. The discarded garbage will travel from the chute of the apparatus to separate refuse containers, which are stationed in a roll-away hollow caddy, for each designated group of recyclable. The caddy containing the separated garbage can then be removed from the hollow housing of the apparatus and rolled away to the curb for pick up.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE INVENTION

In general, the present invention relates to a collection apparatus for collecting and recycling discarded refuse without having to leave the house. A first embodiment of the invention comprises a chute 8 having two side walls 8*d* with outer surfaces, a top end 8*c*, bottom end 8*f* and front end 8*b*, for discarding refuse. The front end and bottom end of the chute has an opening and inner and outer surfaces. The apparatus also contains a hollow housing 6 having a top end 6*a* with an opening and a back door 6*d*. The hollow housing is attached to the bottom end of the chute in such a way that the openings in the bottom end of the chute and top end of the hollow housing are aligned directly over one another. The apparatus further contains a removable hollow caddy 13 which is positioned inside the hollow area 6*e* of the housing when the back door is open. The apparatus still further contains one or more refuse containers 23 positioned inside the hollow area 13*b* of the caddy in such a way that a refuse container is aligned with each compartment made by the partitions. The hollow caddy can also optionally be used as a refuse container.

Figure 1A:
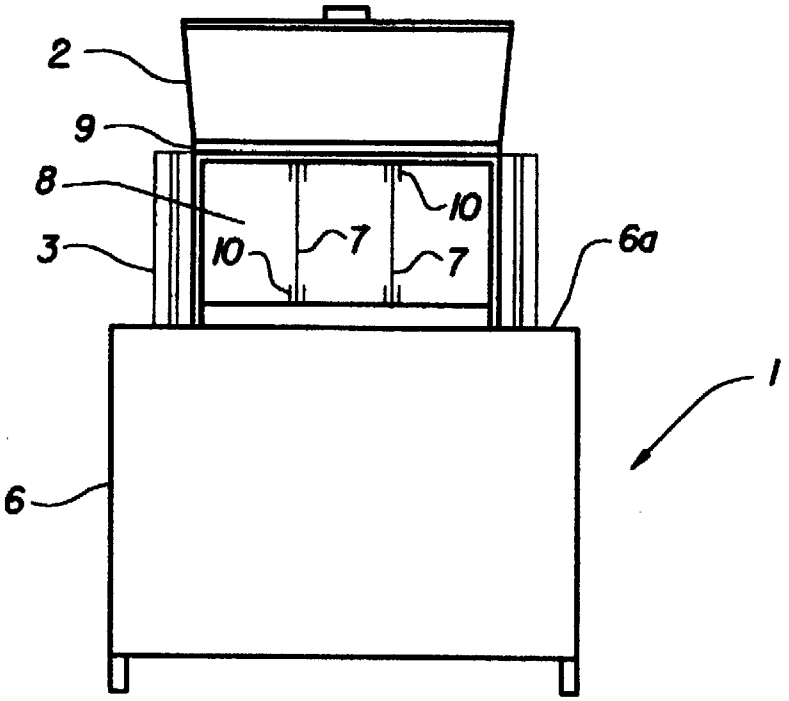
FIG. 1*a* is a frontal view of the refuse collection and recycling apparatus, but showing the existence of partitions which provide a multi-compartment apparatus according to a modification of the first embodiment (second embodiment) of the present invention.
Figure 1:
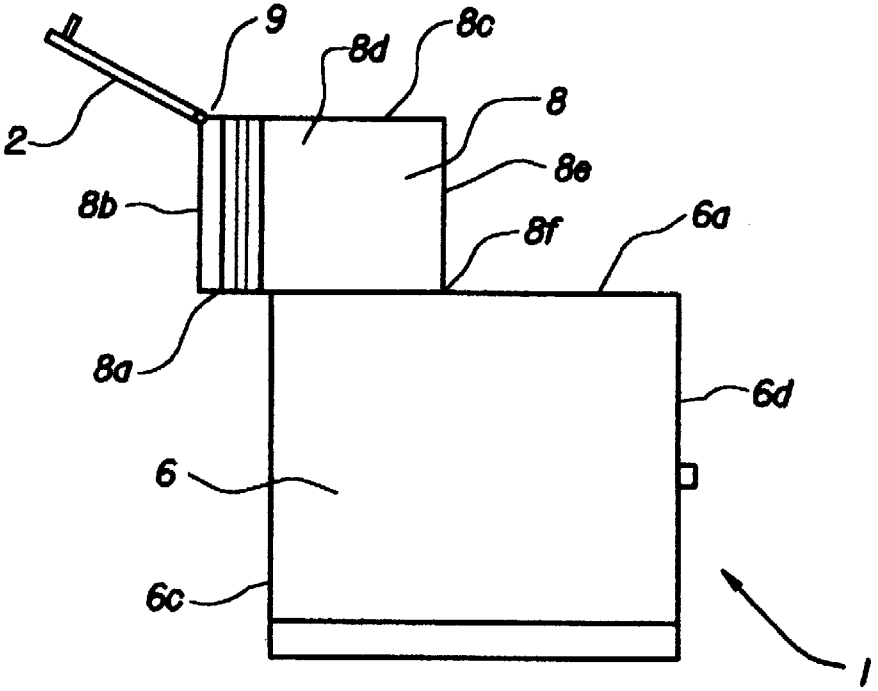
FIG. 1 is a side view of a refuse collection and recycling apparatus according to the first embodiment of the present invention.

A second and preferred embodiment of the present invention is shown in FIG. 1. The multi-compartment refuse collection apparatus (RCA) 1 includes a chute 8 formed in a generally rectangular box-like configuration having a front end 8*b*, a bottom end 8*f* having an opening, a back wall 8*e*, a top wall 8*c*, a partial bottom wall, and two side walls 8*d*. It must be noted that the scope of the instant invention is intended to include not only rectangular box-like configurations, but also circular, octagonal, and the like, or combinations thereof, configurations. The front end 8*b* and bottom end 8*f* both contain openings. The back wall 8*e*, partial bottom wall 8*a* and two side walls all have inner and outer surfaces. The top wall 8*c* has an inner and outer surface; attached to the inner surface is multiple receiving means 10 positioned at the front end 8*b* and back end 8*g* of the top wall of chute 8. The partial bottom wall 8*a* extends from the front end 8*b* of the chute 8 to from about one forth to one half of the length of the top wall 8*c* towards the back wall 8*e*, thereby forming the opening in the bottom end 8*f* of the chute 8. The partial bottom wall 8*a* also contains multiple receiving means 10, which are positioned and aligned to compliment the receiving means contained in the top wall 8*c*. Dislodgeable partitions 7, for providing separate compartments for sorting refuse are inserted into the receiving means 10.

Perpendicularly attached to the outer surface of the top wall 8*c* near the front end of the chute 8 is a mounting bar 9. Mounted on to the mounting bar 9, by a suitable mounting means, is a door 2 which exposes the front end opening of the chute 8 when in an open position and conceals the front end opening when in a closed position. The door can be mounted to be opened in an up and down fashion or alternatively from side to side. The door can also contain a handle for ease in opening and closing. The door is designed in such a way that when in the closed position, closure is air tight thereby minimizing the escape of unpleasant odors from the RCA 1 into the household or building.

FIG. 1*a* shows a front view of the first embodiment of the present invention with an expandable and dislodgeable encasement sleeve 3 attached to the outer surface of the side walls near the front end of the chute 8. The encasement sleeve 3 serves to close off open spaces which may result when the chute 8 does not fit a window or cavity in an air tight manner. The dislodgeable encasement jackets 3 are not required when a cavity is made in the home or building specifically for the RCA 1 (customized).

Figure 2A:
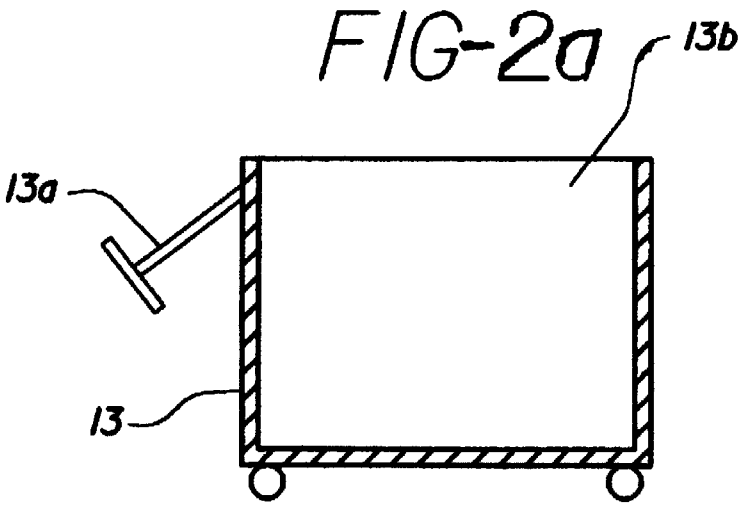
FIG. 2*a* is a cross sectional view of the roll-away hollow caddy which fits into the hollow area of the hollow housing according to the first and second embodiments of the present invention.
Figure 2B:
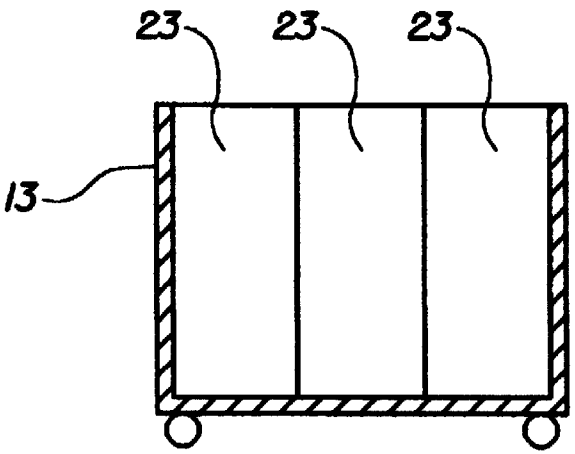
FIG. 2*b* is a view similar to FIG. 2*a*, but particularly showing three refuse containers positioned in the hollow area of the roll-away hollow caddy according to the second embodiment of the present invention.
Figure 2:
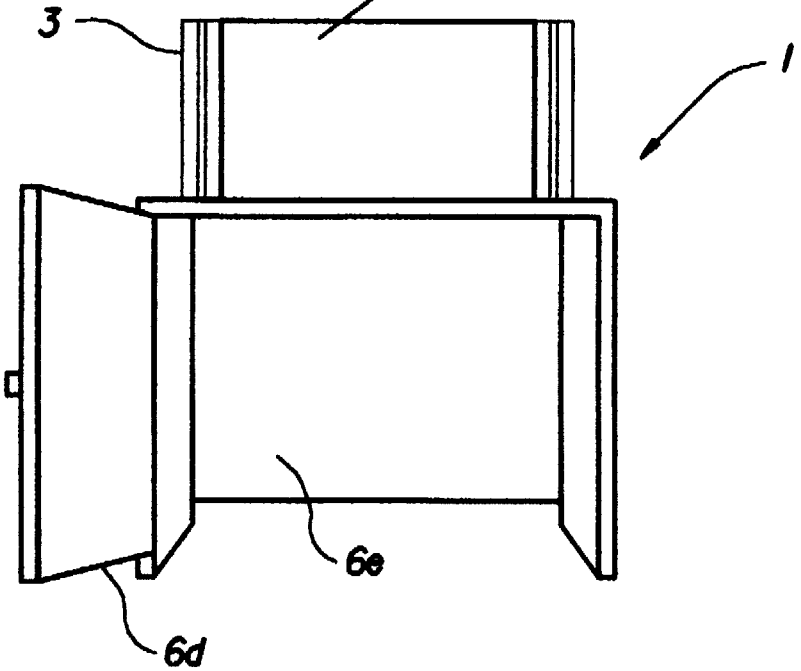
FIG. 2 is a back view of the refuse collection and recycling apparatus showing configuration of the back door and the hollow area of the hollow housing according to the first and second embodiments of the present invention.
Figure 2C:
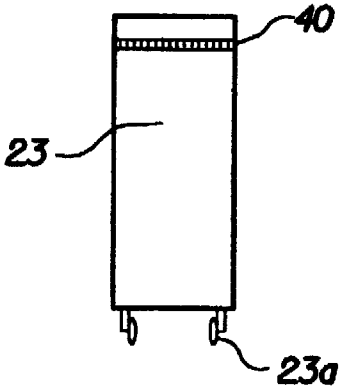
FIG. 2*c* is a cross sectional view of a single refuse container outside of the roll-away hollow caddy and containing a sensor means according to the first and second embodiments of the present invention.

The bottom end of the chute 8 is connected to a hollow housing 6, formed in a generally rectangular box-like configuration (FIGS. 1 and 1*a*) having a top wall 6*a* with an opening and inner surface, two side walls, a front wall 6*c* and a back door 6*d*. The bottom end of the chute 8 is suitably connected to the hollow housing 6 in such a manner that the opening located at the bottom end of chute 8 is neatly and tightly aligned with the opening in the top wall 6*a* of the hollow housing 6. The door 6*c* of the hollow housing 6 when in the open position leads to a compartment 6*d* (FIG. 2) in which a hollow caddy 13 (FIG. 2*a*) having a handle 13*a*, is inserted. The caddy is complimentary in to the hollow housing 6, is shorter in width than the hollow housing 6 and contains wheels at its bottom for rolling to a garbage pickup site. Inside the hollow area of the caddy 13 is inserted one or more individual refuse containers 23 (FIGS. 2*b* and 2*c*). The refuse container has an opening at its top end, a bottom end, and detractable and lockable wheels 23*a* located at the bottom of the refuse container 23. The refuse container can optionally contain handles for assisting in removal to the garbage pick-up site. The detractable and lockable wheels 23*a* are for wheeling an individual refuse container 23 to the garbage pickup site. The number and size of the refuse containers 23 employed depend on the number of partitions 7 utilized in the receiving means 10 of the chute 8. For example, if two partitions are placed in the receiving means 10 of the chute 8, three separate compartments result. This means that three separate refuse containers 23 (FIG. 2*b*) will be inserted in the caddy 13 and will be positioned so that the opening in the refuse containers 23 lines up with the partitioned opening in the bottom end of chute 8.

The RCA 1 can optionally container a sensor means for signaling when one or all refuse containers are at full capacity. Any sensor means known to those skilled in the art can be employed. For example, a sensor means 40 which is located at the top end of the refuse container may give a beeping sound when the refuse container is at full capacity. The RCA 1 can also optionally contain a compactor means suitably located within the refuse containers, for compressing the garbage and providing more garbage disposal capacity.

Figure 3A:
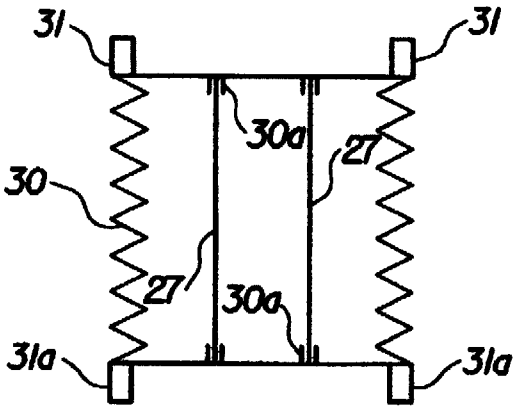
FIG. 3*a* is a cross sectional view of a type of removable and expandable extension means according to the third embodiment of the present invention.
Figure 3B:
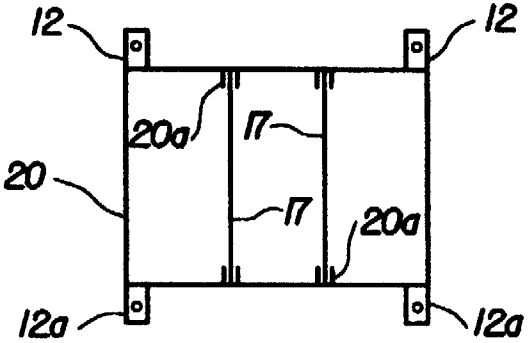
FIG. 3*b* is a cross sectional view of another type of removable and expandable extension means according to the third embodiment of the present invention.
Figure 3:
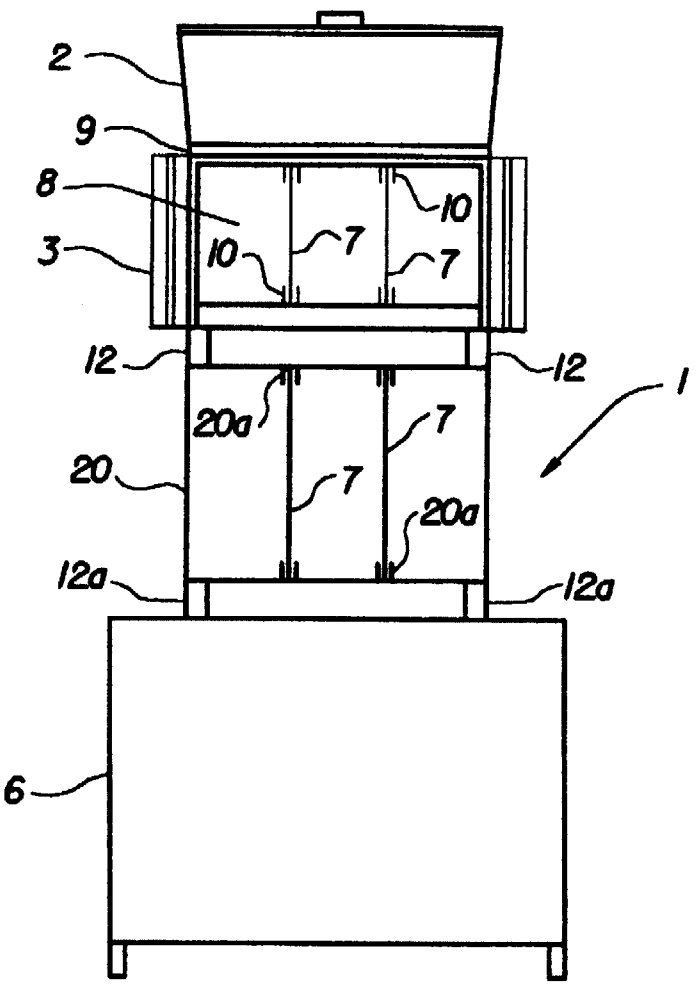
FIG. 3 is a frontal view of the refuse collection and recycling apparatus, but particularly showing the addition of a removable and expandable extension means between the chute and hollow housing of the refuse collection apparatus according to the first and second embodiments (third embodiment) of the present invention.

The most preferred embodiment of the present invention is realized when the RCA 1 contains a hollow flexible extension means. The configuration of the hollow flexible extension means compliments the configuration of the chute 8 and hollow housing 6 and the method of attachment of the hollow flexible extension means is by any means known in the art. By way of example, the RCA 1 can contain a hollow flexible extension means like that illustrated in FIGS. 3, 3*a*, and 3*b*. The flexible extension means 20/30 has an inner surface, a first and second flange means 12, 12*a*/31, 31*a* and a plurality of receiving means 20*a*/30*a*; the receiving means 20*a*/30*a* is located on the inner surface of the flexible extensions means 20/30 and spaced suitably apart to be aligned with the receiving means contained in the chute 8. The flexible extension means 20/30 serves to adjust the RCA 1 to the proper height when placing the chute 8 into a window or customized cavity. The flexible extension means 20/30, is attached to the RCA 1 by securing the first flange means 12/31 of the flexible extension means 20/30 to the inner surfaces of the back, partial bottom and two side walls of the chute 8 by any securing means known in the art. Likewise, the second flange means 12*a*/31*a* of the flexible extension means 20/30 is attached to the hollow housing 6 by securing it to the top of wall of the hollow housing 6 by a suitable securing means. The flexible extension means 20/30 contains expandable and flexible partitions 17/27 which are inserted into the receiving means 20*a*/30*a* of the flexible extension means 20/30. The number of flexible partitions 17/27 employed will equal the number of partitions 7 utilized in the chute 8; the flexible partitions 17/27 will be positioned to be vertically aligned with the partitions 7 of the chute 8 and the edges of two or more refuse containers 23.

In operation, the front end of the chute of the collection apparatus is inserted from the outside of a house or dwelling into a window or customized cavity and connected to the house or dwelling by a suitable connecting means. If the window or cavity is wider than the width of the chute 8 then the encasement sleeve 3 can be used to seal off the opened area of the window or cavity. From inside the house or dwelling the door of the chute 8 is opened revealing one or more compartments depending on the number of partitions employed. Refuse is then thrown into the front end opening of the chute and travels through the openings in bottom end of the chute and top end of the hollow housing to the refuse container(s) where it is collected.

In the case where, say for example, 2 partitions are used three separate compartments result. Each compartment can be used to dispose either cans, bottles, paper, non-recyclable refuse such as general household garbage, or a combination thereof. Once one or all of the refuse containers reach full capacity the optional sensor means sends a signal indicating that a particular container or all containers need to be emptied.

When the refuse container(s) need to be emptied the back door of the hollow housing 6 is opened revealing the caddy which contains the three refuse containers. If all three refuse containers need to be emptied the caddy can be rolled out to the garbage pick-up site. If only one refuse container needs to be emptied then it can be removed from the caddy. If no refuse containers are used then the hollow caddy can serve as a refuse container.

Upon removal of the refuse container from the caddy the wheels contained at the bottom of the refuse container will come down so that the refuse container can be rolled to the garbage pick-up site. Once the refuse container(s) have been emptied they can be put back into the caddy and the caddy replaced inside the hollow housing 6 of the RCA for reuse.

What is claimed is:

1. A collection apparatus for collecting and recycling discarded refuse, comprising a chute having two side walls with outer surfaces, a top end, bottom end, front top end and front end, the front end and bottom end having an opening and inner and outer surfaces, the chute containing a first set of one or more receiving means attached to the inner surface of the top end and bottom end of the chute, the first set of receiving means containing one or more dislodgeable partitions to provide multiple discarding compartments, the chute containing a mounting bar perpendicularly secured to the front top end of the chute; a first door mounted to the mounting bar to seal off the front end opening of the chute; a hollow housing having a top and bottom end, both containing an opening, a hollow area, 3 walls and a back door, the top end of the hollow housing attached to the bottom end of the chute in such a way that the openings in the bottom end of the chute and top end of the hollow housing are aligned directly over one another; a removable hollow caddy, which is positioned inside the hollow area of the housing via the back door when it is open; and a number of one or more refuse containers positioned inside the hollow area of the caddy in such a way that said one or more refuse containers is aligned with each compartment made by the partitions, the collection apparatus for collecting the discarded refuse which travels from the front end opening of the chute through the openings in the bottom end of the chute and the top end of the hollow housing to said one or more refuse containers where the discarded refuse is collected, wherein the number of refuse containers employed equals the number of discarding compartments made by the dislodgeable partitions.

2. A collection apparatus according to claim 1 which can optionally contain a removable and expandable extension means having a wall on all sides and an opening at its top and bottom ends, for extending the height of the collection apparatus so that the chute fits suitably in a window or cavity, the removable and expandable extension means having an inner surface, a first and second flange means, and a second set of one or more receiving means, the receiving means attached to the inner surface, the first flange means being located at the top end of the removable and expandable extension means and attached to the bottom end of the chute and the second flange means being located at the bottom end of the removable and expandable extension means and attached to the top end of the hollow housing, the removable and expandable extension means being attached in such a way that the openings in the bottom end of the chute, top end and bottom end of the removable and expandable extension means and top end of the hollow housing are all aligned over one another.

3. A collection apparatus according to claim 2 wherein expandable and dislodgeable partitions are inserted into the receiving means of the removable and expandable extension means to provide multiple compartments, the number of expandable and dislodgeable partitions equaling the number of dislodgeable patrons used in the chute and the number of refuse containers employed equaling the number of compartments made by the insertion of dislogeable partitions in the chute.

4. A collection apparatus according to claim 3 wherein the sensor means is located on said one or more refuse containers.

5. A collection apparatus according to claim 1 wherein the outer surface of the two side walls of the chute can optionally contain a removable and adjustable encasement sleeve for sealing off open areas of a window or a cavity.

6. A collection apparatus according to claim 1 wherein the hollow caddy can also be used as said one or more refuse containers.

7. A collection apparatus according to claim 1 which contains a sensors means for signaling when one or all refuse containers are at full capacity.

8. A collection apparatus for collecting and recycling discarded refuse, comprising a chute having two side walls with outer surfaces, a top end, bottom end, front top end and front end, the front end and bottom end having an opening and inner and outer surfaces, the chute containing a first set of one or more receiving means attached to the inner surface of the top end and bottom end of the chute, the first set of receiving means containing one or more dislodgeable partitions to provide multiple discarding compartments, the chute containing a mounting bar perpendicularly secured to the front top end of the chute; a first door mounted to the mounting bar to seal off the front end opening of the chute; a removable and expandable extension means having a wall on all sides and an opening at its top and bottom ends for extending the height of the collection apparatus so that the chute fits suitably in a window or cavity, the removable and expandable extension means having an inner surface, a first and second flange means and a second set of one or more receiving means, the receiving means attached to the inner surface, the first flange means being located at the top end of the removable and expandable extension means and attached to the bottom end of the chute, and the second flange means being located at the bottom end of the removable and expandable extension means; a hollow housing having a top and bottom end, both containing an opening, a hollow area, 3 walls and a back door, the top end of the hollow housing being attached to the second flange means of the removable and expandable extension means in such a way that the opening in the bottom end of the chute, in the top and bottoms ends of the removable and expandable extension means and in the top end of the hollow housing are aligned over one another, the second set of one or more expandable receiving means of the removable and expandable extension means containing expandable and dislodgeable partitions which equal in number and is aligned with the first set of receiving means in the chute to provide multiple discarding compartments; a removable hollow caddy, which is positioned inside the hollow area of the housing via the back door when it is open; and a number of one or more refuse containers positioned inside the hollow area of the caddy in such a way that said one or more refuse containers is aligned with each compartment made by the partitions, the collection apparatus for collecting the discarded refuse which travels from the front end opening of the chute through the openings in the bottom end of the chute, the top and bottom end of the removable and dislodgeable extension means and the top end of the hollow housing to said one or more refuse containers where the discarded refuse is collected, wherein the number of refuse containers employed equals the number of discarding compartments made by the dislodgeable partitions.

9. A collection apparatus according to claim 8 wherein the hollow caddy can also be used as one or more refuse containers.

10. A collection apparatus according to claim 8 which contains a sensors means for signaling when one or all refuse containers are at full capacity.

11. A collection apparatus according to claim 8 wherein the sensor means is located on said one or more refuse containers.

* * * * *